US012302988B2

(12) United States Patent
Bigolin et al.

(10) Patent No.: US 12,302,988 B2
(45) Date of Patent: May 20, 2025

(54) SPORTS SHOE, IN PARTICULAR CYCLING SHOE

(71) Applicant: Selle Royal S.p.A., Pozzoleone (IT)

(72) Inventors: Barbara Bigolin, Vicenza (IT); Stefano Meneghetti, Vicenza (IT)

(73) Assignee: SELLE ROYAL S.P.A., Pozzoleone (IT)

( * ) Notice: Subject to any disclaimer, the term of this patent is extended or adjusted under 35 U.S.C. 154(b) by 226 days.

(21) Appl. No.: 17/632,965

(22) PCT Filed: Aug. 5, 2020

(86) PCT No.: PCT/IB2020/057405
§ 371 (c)(1),
(2) Date: Feb. 4, 2022

(87) PCT Pub. No.: WO2021/024203
PCT Pub. Date: Feb. 11, 2021

(65) Prior Publication Data

US 2022/0287411 A1 Sep. 15, 2022

(30) Foreign Application Priority Data

Aug. 5, 2019 (IT) ..... 102019000014082

(51) Int. Cl.

| | |
|---|---|
| ***A43B 5/14*** | (2006.01) |
| ***A43B 7/14*** | (2022.01) |
| ***A43B 7/24*** | (2006.01) |
| ***A43B 7/28*** | (2006.01) |
| ***A43B 17/02*** | (2006.01) |
| ***A43B 23/22*** | (2006.01) |
| ***A43D 86/00*** | (2006.01) |

(52) U.S. Cl.
CPC ..... *A43B 17/02* (2013.01); *A43B 5/14* (2013.01); *A43B 7/1495* (2013.01); *A43B 7/24* (2013.01); *A43B 7/28* (2013.01); *A43B 23/222* (2013.01); *A43B 23/227* (2013.01); *A43D 86/00* (2013.01)

(58) Field of Classification Search
CPC ..... A43B 7/1495; A43B 7/28; A43B 7/18; A43B 7/24; A43B 23/22; A43B 23/222; A43B 23/227; A43B 5/14
USPC ..... 36/131
See application file for complete search history.

(56) References Cited

U.S. PATENT DOCUMENTS 1,976,819 A 10/1934 Weiler
6,393,733 B1 * 5/2002 London ..... A43B 7/1495 36/170

(Continued)

FOREIGN PATENT DOCUMENTS

DE 3812186 A1 11/1988
DE 69102951 T2 11/1994

(Continued)

OTHER PUBLICATIONS

English Translation of EP 0746990 (Year: 1996).*

(Continued)

*Primary Examiner* — Ted Kavanaugh
(74) *Attorney, Agent, or Firm* — Tutunjian & Bitetto, P.C.

(57) ABSTRACT

The present invention relates to a shoe, for example a sports shoe, such as a cycling shoe including a sole, an upper constrained to the sole and an insole inserted in the upper or constrained to the open bottom of the upper.

13 Claims, 3 Drawing Sheets

(56) References Cited

U.S. PATENT DOCUMENTS

| | | | | |
|---|---|---|---|---|
| 8,225,534 | B2 * | 7/2012 | Mueller | A43B 5/12 36/76 R |
| 10,631,590 | B2 * | 4/2020 | Sterman | A43B 17/006 |
| 2011/0056095 | A1 * | 3/2011 | Torrance | A43B 3/24 36/114 |
| 2011/0113648 | A1 * | 5/2011 | Leick | A43B 5/14 36/50.1 |
| 2016/0021978 | A1 * | 1/2016 | Bae | A43B 7/28 36/44 |
| 2016/0157561 | A1 * | 6/2016 | Schum | A43B 3/34 242/390 |
| 2016/0213089 | A1 | 7/2016 | Chen et al. | |
| 2016/0338449 | A1 * | 11/2016 | Steuerwald | A43B 5/14 |
| 2018/0160764 | A1 * | 6/2018 | Garneau | A43B 23/0205 |
| 2019/0069626 | A1 * | 3/2019 | Kuefler | A43B 23/0245 |

FOREIGN PATENT DOCUMENTS

| | | | |
|---|---|---|---|
| EP | 0746990 | A1 * | 12/1996 |
| GB | 465012 | A | 4/1937 |

OTHER PUBLICATIONS

International Search Report for PCT/IB2020/057405 dated Sep. 3, 2020 (3 pages).
Written Opinion for PCT/IB2020/057405 dated Feb. 11, 2021 (7 pages).

* cited by examiner

SPORTS SHOE, IN PARTICULAR CYCLING SHOE

TECHNICAL FIELD OF THE INVENTION

The present invention relates to a sports shoe, in particular a cycling shoe.

TECHNICAL BACKGROUND

In shoes generally with classic to sporty lines, the foot finds its proper housing in reference to its size defined as standard, but as is known all feet are characterized by different morphologies, and this often results in an unsatisfactory support and wrapping of the foot by the upper.

Regarding cycling in particular, for which the shoes are well anchored to the pedals at which heavy loads are exerted, during the cyclical movement the foot is often not adequately supported, nor wrapped by the upper in the area of the plantar vault.

This aspect is defined by athletes, sports trainers and biomechanics as a power loss expressed in WATTS towards the pedal.

To try to overcome this deficit, users are forced to considerably tighten the closure to eliminate the "void" between the inner sole and the foot, causing unpredictable disturbances during use such as tingling or, over time, the formation of over-bones due to the high compression exerted by the excessive closure on the foot by the upper.

Users are therefore always seeking solutions to this problem, and in most cases can only resort to specific correction insoles.

US20160213089A1 describes a cycling shoe with a sole, upper and closing means shaped to wrap the sole of the foot, wrapping it so as to secure it firmly to the sole and thus ensure an adequate transmission of power to the pedals.

The closing means wrap the sole of the foot, with particular reference to the arch portion of the foot, thus ensuring a correct posture of the foot during use.

However, such a solution does neither guarantee proper arch support of a user's foot, nor satisfactory adjustability.

SUMMARY OF THE INVENTION

An object of the present invention is to provide a new shoe, for example sports shoe, in particular a cycling shoe, but also a walking or leisure shoe.

Another object of the present invention is to provide a shoe as mentioned above which is capable of providing an insole such as to suitably support the arch and at the same time a support system integrated with the upper and sole easily and precisely adjustable without the need for high forces by means of any type of closure.

Another object of the present invention is to provide a shoe also adapted to be used people with flat/prone feet who suffer from disorders such as tibialis posterior tendinosis.

Another object of the present invention is to provide a shoe with a simple and inexpensive construction which can be easily used in the desired configuration also by non-specialized individuals according to their particular comfort needs.

Another object of the present invention is to provide a shoe as mentioned above that is such as to ensure optimal tightening without compromising the torsion of the sole.

According to one aspect of the invention a shoe according to the present application is provided.

The present application refers to preferred and advantageous embodiments of the invention.

BRIEF DESCRIPTION OF THE DRAWINGS

Other characteristics and advantages of the invention will be more evident from the description of an embodiment of a shoe, illustrated by way of example in the accompanying drawings wherein.

In the accompanying drawings, identical parts or components are distinguished by the same reference numerals.

DETAILED DESCRIPTION OF THE INVENTION

Figure 1:
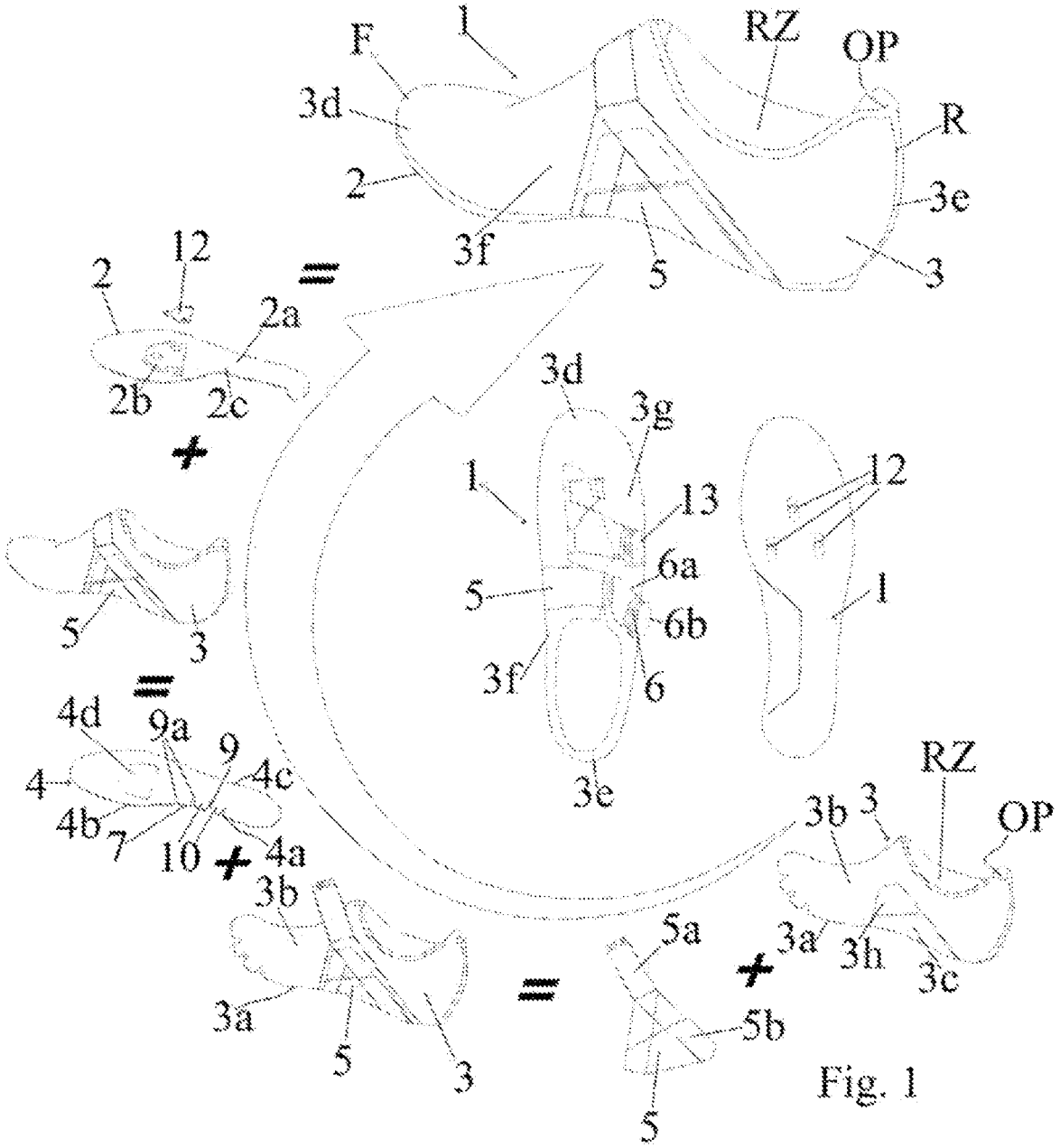
FIG. 1 schematically illustrates the steps of a method according to the present invention for obtaining a shoe according to the present invention.

With reference to the attached figures, a shoe 1, for example a sports shoe, such as a cycling shoe, but also a walking or leisure shoe, has been illustrated, which shoe comprises a sole 2, an upper 3 directly or indirectly constrained to the sole 2 and an insole 4 inserted in the upper 3 and arranged opposite to the sole 2 with respect to the bottom 3*a* of the upper 3 or constrained on the open bottom 3*a* of the upper 3 and then constrained to the sole 2 or closed below by the sole 2, which, in turn, is connected to the upper 3.

More in particular, the insole 4 may be inserted and glued or otherwise constrained, for example with adhesive inside the upper 3 or to the open bottom 3*a* of the upper 2, while the sole 2 is glued or constrained by other means, for example adhesive to the upper 2 or the insole 4, if the latter is constrained to the open bottom of the upper 3, or to the closed bottom of the upper 3 with the insole 4 inside the latter.

Clearly, if the insole 4 is inserted in the upper 3, then it is inserted starting from the opening OP delimited by the upper 3 and within the housing area RZ of the foot delimited by the upper 3 itself until it rests, substantially entirely on the bottom wall of the latter, more particularly on the inner, in use, surface of the latter.

The shoe 1 further comprises at least one strip or tape or belt or pull component 5 for tightening the upper 3 around a user's foot as well as adjustable and removable engagement means 6 of the strip or tape or belt 5 or better of a respective end section or free end 5*a* on the upper 3.

It will be understood that the strip or tape or belt or pull component 5 in combination with the engagement means 6 serves to tighten the upper 3 so as to narrow the housing area RZ of the foot delimited by the upper itself after the insertion therein of a user's foot. If desired, the strip or tape or belt or pull component 5, always in combination with the engagement means 6, may also be used to narrow or enlarge the opening OP delimited by the upper 3 and intended to allow the insertion of a user's foot in the shoe 1 or better in the housing area RZ.

Preferably, the engagement means 6 are fixed, for example glued or sewn into a side, preferably, outer 3*g*, of the shoe or better of the upper 3 opposite to that, preferably, inner or medial 3*f* of fixing, gluing or sewing the strip or tape or belt or pull component 5.

Thus, the tightening or pulling action of the strip or tape or belt or pull component 5 by the engagement means 6 is advantageously performed from the medial (inner) side towards the lateral (outer) side of the shoe.

In this regard, the strip or tape or belt or pull component 5 could be made of fabric or leather, synthetic or composite material of various kinds.

The insole 4 may instead be made of various kinds of extruded, moulded or thermoformed material. Such a component 4 may be in the form of a midsole or the like.

In this regard, the insole 4 could be obtained entirely and as a single piece by thermoforming.

Alternatively, the insole 4 may be coupled by thermoforming. With reference to this aspect, two or more materials could be used to obtain two or more parts of the insole 4, which parts would then be connected to each other by thermoforming. In this case, the use of two or more materials would make it possible to lighten some areas of the insole 4 compared to others or to obtain different performance (such as flexibility or strength) in different areas of the insole 4.

Moreover, as will be mentioned later, the insole 4 may also include multiple overlapping layers for all or part of the extension thereof.

The sole 2 may be in any suitable material, for example carbon or carbon fibre.

The adjustable engagement means 6 could instead be of any suitable type and if desired comprise an insertion or constraint eyelet of one end of the strip or tape or belt or pull component 5, of Velcro means, a mechanism, such as a rotor, a rack, a lever or other designed to pull an end of the strip or tape 5 or a cable or similar integral with the latter. Clearly, the engagement means 6 are in whole or in part integral with a respective part of the upper, for example fixed, if desired sewn or glued thereto.

With reference to the specific non-limiting embodiment illustrated in the figures, the engagement means 6 comprise a cable 6*a* acting on one end of the strip or tape 5 for example an eyelet part of a terminal section or free end 5*a*, which cable is engaged by a respective control component, such as a knob 6*b* rotatable on or from a portion of which the cable 6*a* can be wound/unwound, in which case the knob 6*b* would be fixed, if desired sewn or glued, to the upper 3.

The shoe then comprises means for facilitating or increasing 7, 3*c* the movement of the strip or tape or belt 5 with respect to the insole 4 and/or the upper 3 designed to allow the adaptation of the action of tightening the strip or tape or belt 5 on the upper 3.

Advantageously, such means 7, 3*c* are designed to increase the tightening or pulling action on the upper 3 by the strip or tape or belt or pull component 5 in the direction from the inside or medial side outwards or lateral side of the shoe. In this regard, the facilitating or increasing means are preferably provided for or act from or on the medial or inner side of the shoe.

In this regard, the facilitating or increasing means may comprise at least one flexible or deformable section 7, for example jagged or lightened in an edge portion 4*a* of the insole 4 at the attachment base 5*b* of the strip or tape or belt 5.

More particularly, the flexible or deformable section 7 is arranged in an edge portion 4*a* of the insole actually enclosed, in use, in whole or in part by the strip or tape or belt 5, such that by tightening the latter causes a bending of the jagged or lightened flexible section 7 and thereby increases or facilitates the tightening action of, for example, the strip or tape 5. Clearly, between the flexible section 7 and the strip or tape or belt 5, the upper 3 is arranged or interposed.

Of course, the flexible or deformable section 7 is arranged only in an edge portion 4*a* of the insole 4 and not in the entire insole 4.

Advantageously, the tightening action now summoned is not imparted to the entire insole 4, but only to the jagged or lightened flexible section 7.

Such jagged section 7 is delimited by two, three, four or more lightening portions extending into an edge portion 4*a* or notches preferably, but not necessarily, through notches 9 extending from an edge portion 4*a* towards the centreline of the insole 4, which notches or lightening portions 9 are such as to define one, two, three or more flexible and separate or foldable tabs or portions, in particular separately 10, adapted to be bent, preferably each substantially independently of the others, with respect to the remaining parts of the insole 4 when the strip or tape or belt 5 is tightened on the upper 3.

The notches 9 then have an inner end 9*a* distal from the edge portion 4*a* and can be closed or opened or vented at the latter. Furthermore, if the notches 9 are through, they are through in the thickness direction of the insole 4.

If the notches are not through, then the insole 4 could for example be formed by two overlapping layers, a first lower, in use, layer and a second upper, in use, layer with a different elasticity (greater or lesser) than the first layer with the notches formed only in one of the two layers for the entire thickness of that layer, or notches formed only for part of the thickness of the insole would be present.

In any case, the through notches or not through notches would increase the flexibility or better the deformability of the flexible section.

Alternatively, it could have a first layer with a certain flexibility/elasticity, and at least a second layer smaller than the first layer and with greater flexibility/elasticity than the latter, which second layer would be applied only in the edge portion 4*a* of the insole 4 at the attachment base 5*b* of the strip or tape or belt 5. The second layer would then constitute a lightening portion.

More particularly, the notches 9, if present, may have an extension between about 0.5 and 3 cm. Clearly, the notches 9 need not all have the same extension.

Such notches 9 preferably extend in the direction from one side 4*b* to the other 4*c* of the insole 4, although they may or may not be parallel to each other.

The notches 9 or the lightening portion(s) are preferably obtained from an intermediate section of the side, in use, internal or medial 4*b* of the insole 4. More particularly, the notches 9 or the lightening portions are obtained in an area of length between about ¼ and about ⅓ of the rear R-front F length or distance of the insole 4 and at a distance of between about ⅕ and ¼ from the rear R.

In this regard, the inner, in use, ends 9*a*, i.e., those distal to the respective edge portion 4*a*, of the notches 9, may or may not be aligned along a curved section, such as to resume the inner curvature of the shoe or better of the respective sole.

If there is a flexible or deformable section 7 as indicated above, it is not firmly constrained or fixed in position either to the upper 3, or to the sole 2, so that the flexible or deformable section 7 can or is free to move with respect to the upper 3, in particular as a result of the tightening action imparted by the strip or tape or belt or pull component 5. In such a case, then the insole 4 is preferably firmly constrained or fixed in position, for example glued or adhered, to the upper 3 for the entire extension thereof or better along the entire perimeter edge thereof, except for at the flexible or deformable section 7.

The expression "constrained or securely fixed in position" clearly means a rigid locking between two components and that does not substantially make it possible a relative displacements therebetween.

The upper 3 optionally comprises a main part 3*b* and a completion part 3*c* of the main part 3*b* or the upper 3 which is elastically extensible, while the main part 3*b* is rigid or otherwise elastically extensible to a lesser extent than the completion part 3*c*.

In this regard, the upper 3 comprises a main body defining a tip 3*d*, a heel portion 3*e* and two sides 3*f*, 3*g* which delimit at the back the opening OP which opens, in use, upwards intended to allow the insertion of a user's foot into the shoe 1

The upper 3 may then include a bottom wall or an open bottom 3*a* delimited by the lower edges of the tip 3*d*, the heel portion 3*e* and the two sides 3*f*, 3*g*.

In such a case, the completion portion 3*c* constitutes a portion of a side 3*f*, in particular of the inner side of the upper 3.

More particularly, the completion part 3*c* may extend from the bottom of the inner side 3*f* of the upper 3. Still more particularly, the completion part 3*c* may extend in an area of length between about ¼ and about ⅓ of the length or the rear R-front F distance of the insole 4 and at a distance between about ⅕ and ¼ from the rear R.

Moreover, the completion part 3*c* may be tapered from the bottom to the top.

If desired, the completion part 3*c* may be substantially inclined configured or better with an inclined centreline and more particularly with an upper end closer to the front F of the respective lower end.

The completion part 3*c* may have an edge consisting of four perimeter sections inclined to each other and more particularly, a lower section at the bottom of the upper 3, an upper section and two side sections.

The completion part 3*c* may be constrained to the main part 3*b* by any suitable method, for example sewing or realized therewith during the same weaving or construction process.

In this case, the facilitating or increasing means comprise the elastically extensible completion part 3*c* of the upper 3 and the strip or tape or belt 5 is fixed, if desired glued, at the elastically extendible completion part 3*c* or sliding thereon so as to allow, when necessary, the strip or tape or belt 5 to move independently from the main part 3*b* of the upper 3 for an adaptation, such as an increase in the tightening of the latter. Preferably, the strip or tape or belt 5 is fixed, if desired glued, only at the completion part 3*c*.

Clearly, the completion part 3*c* may be applied above the main part 3*a* or in a special opening delimited therefrom.

Advantageously, the completion part 3*c* emerges outside the shoe or better the upper 3.

The completion part 3*c* may have variable elasticity, while the main part 3*b* may have elasticity lower than the completion part 3*c*.

Moreover, the completion part 3*c* may be made of light fabric which, depending on the characteristics, will be sufficiently extensible, while the main part 3*b* may be made of fabric, leather, synthetic or composite material of various kinds with possible internal reinforcing inserts.

If the upper 3 comprises a bottom wall 3*a* then the insole 4 is constrained internally to the latter preferably for the entire extension thereof, whereas if the upper 3 comprises an open bottom, then the insole 4 is constrained on the delimiting edges of the latter and delimits with the upper 3 the housing area RZ.

With reference to this aspect, as indicated above, if a flexible or deformable section 7 as indicated above is provided, it is neither constrained to the upper 3, nor to the sole 2, so that the flexible or deformable section 7 is free to move, in particular as a result of the tightening action imparted by the strip or tape or belt or pull component 5. In such a case, then the insole 4 is preferably constrained, for example glued to the upper 3 or to the open or closed bottom of the same throughout the extension thereof, except for the flexible or deformable section 7.

If desired, the upper 3 may comprise a decorative part or layer 3*h* placed immediately above the completion part 3*c* and placed, in fact, as a continuation of the same, which is suitably decorated or otherwise made of a material such as to show an aesthetically pleasing surface. The decorative part 3*h* may be constrained to the main part 3*b* by any suitable method, for example sewing or it is realized therewith during the same weaving or construction process.

The strip or tape or belt 5 may be fixed, if desired glued or constrained by adhesive or sewing on one side of the upper 3.

More particularly, the strip or tape or belt 5 has an attachment base 5*b* which can be constrained in whole or in part to the upper 3 and an end section 5*a* fixable or removably and adjustably engageable with the engagement means 6.

The attachment base 5*b* may be made by means of one or more pieces or bands of fabric, if desired elastic or even leather, synthetic or composite material of various kinds, which bands are fixed together, for example glued or connected by adhesive.

The lower portion of the attachment base 5*b* could be covered both internally and externally, by a layer of material, if desired over-injected, for example in nylon.

The attachment base 5*b* may have a wider width, for example between 2 and 4 times the width of the end section 5*a* and be tapered, for example, approaching the end section 5*a*.

Clearly, the strip or tape or belt 5 may be attached, glued, sewn or connected by adhesive, to the upper 3 or better, if provided, to the completion part 3*c* and only for a part of the extension thereof (the strip or tape 5) and, more particularly at the respective attachment base 5*b* for all or part of the extension thereof. Preferably, the end section 5*a* is not fixed or constrained directly to the upper 3, but through the attachment base 5*b*, whereby the end section 5*a* is substantially free and removably and adjustably engageable with the engagement means 6.

The end section 5*a* may have a length between about the length of the attachment base 5*b*.

The upper 3 may delimit a recessed portion 3*m*, in which case the attachment base 5*b* of the strip or tape or belt 5 may be housed and fixed, for example to size in the recessed portion 3*m*.

In such case, the recessed portion 3*m* may comprise the elastically extensible completion part 3*c* and if desired and if present, also the decoration part 3*h*.

Figure 2:
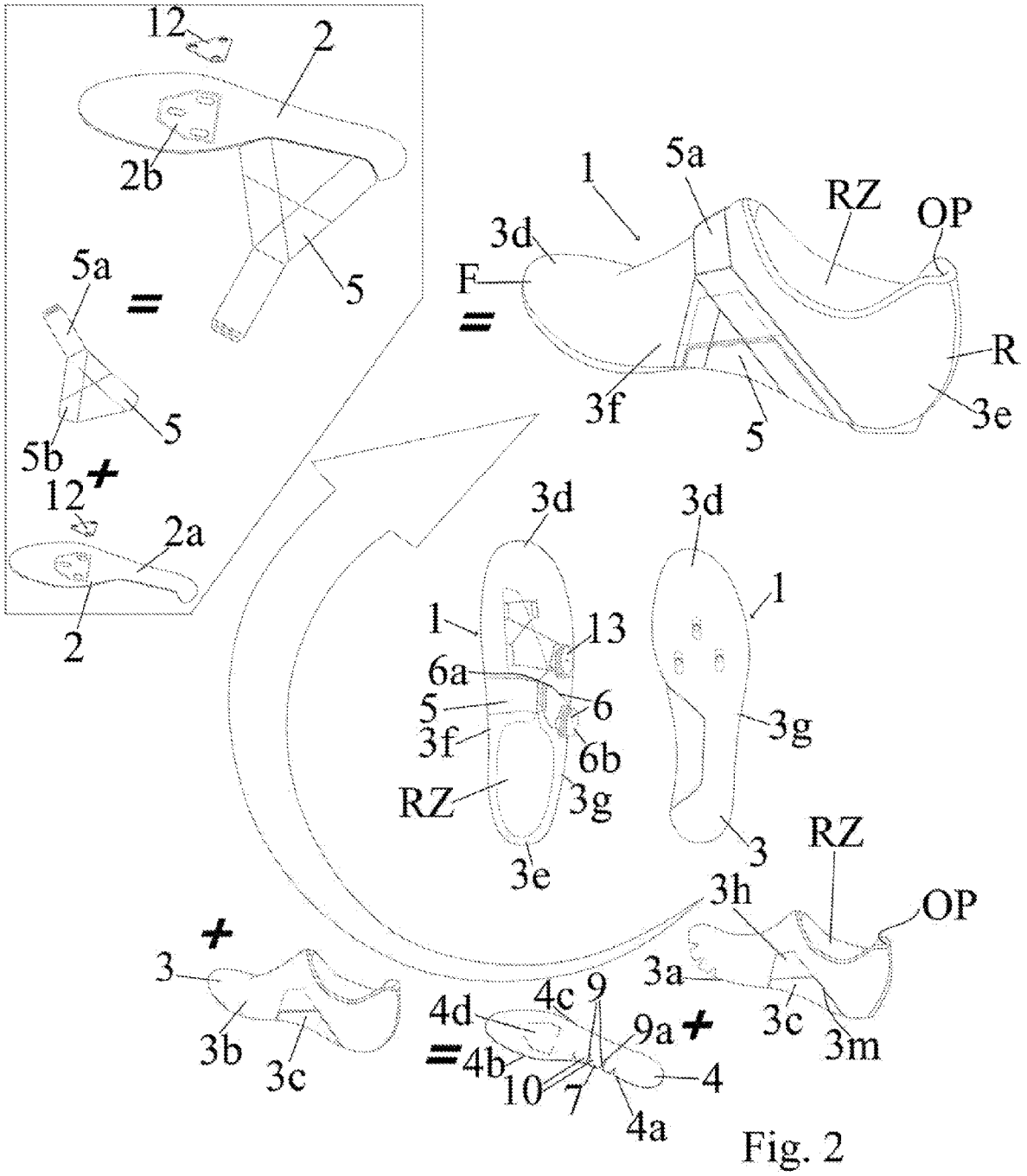
FIG. 2 is a view similar to FIG. 1 which schematically illustrates the steps of another method according to the present invention for obtaining another shoe according to the present invention.

Preferably, the strip or tape or belt 5 may be attached only to the upper 3 (see FIG. 1) or to both the sole 2 and on one side of the upper 3 (see FIG. 2).

In this second case, a part of the attachment base 5*b* is fixed or constrained to the sole 2, if desired at a lower, in use, portion of the same and another part of the attachment base 5*b* is fixed, glued, sewn or connected by means of adhesive, to the upper 3, if desired as indicated above.

The attachment base 5*b* could also be fixed or constrained only to the sole 2 by gluing, adhesive or engagement of respective connectors, for example by fitting or engagement, if desired snap fitting or engagement between the attachment base 5*b* and the sole 2. In this regard pins or the like could be provided on the sole 2 and slots or engagement holes of the pins in the attachment base 5*b* or vice versa. Such connectors would remain clearly attached when the various components of the shoe are closed or sandwiched together.

Of course, the attachment base 5*b* could also be tightened between the sole 2 and upper 3.

If desired, the sole 2 is recessed or in any case delimits a basin or concavity 2*a* towards the insole 4, so as to allow the strip or tape or belt 5 and the insole 4 excursions in such a way as to wind and sustain the arch of the foot, without compromising the torsion of the sole.

The shoe 1 may then comprise means for constraining 12 to a pedal of a bicycle, for example a stud or other suitable component housable in a seat 2*b* delimited by the sole 2, for example at the surface 2*c* facing the insole 4.

With reference to this aspect, the insole 4 at the respective lower surface, can delimit depression 4*d* at the stud 12, this in particular if the insole 4 is attached to the open bottom of upper 3 to close the same.

Clearly, a shoe according to the present invention may also include closing/opening means 13, any suitable means, such as a cable or the like, for supporting the strip or tape or belt or pull component 5 in the respective tightening action.

A subject-matter of the present invention is also an insole 4 as indicated above.

According to the present invention a method is also provided for assembling a shoe 1, comprising (see in particular FIG. 1) the following steps in sequence:

- arranging a sole 2, an upper 3, an insole 4 and at least one tightening strip or tape or belt 5,
- constraining, by any suitable method, e.g. as mentioned above, the tightening strip or tape or belt 5 to the upper 3, e.g. the attachment base 5*b* to the completion part 3*c*,
- constraining the insole 4 by any suitable method, e.g. as mentioned above, to the first unit comprising the tightening strip or tape or belt 5 and the upper 3, in particular to the bottom 3*a* of the upper 3 or inserting the insole 4 in the upper 3 and substantially constraining it entirely on the bottom wall of the latter, more particularly on the inner, in use, surface of the latter, and
- constraining the sole 2 by any suitable method, e.g. as mentioned above, below the assembly comprising the tightening strip or tape or belt 5, the upper 3 and the insole 4, in particular to the insole 4 or the closed bottom of the upper 3.

Alternatively, a method for assembling a shoe according to the present invention, comprises the following steps in sequence:

- arranging an upper 3 and an insole 4,
- constraining the insole 4 below the upper 3 or better to the open bottom 3*a* of the latter or inserting the insole in the upper 3,
- arranging a sole 2 and at least one tightening strip or tape or belt 5 and then constraining the tightening strip or tape or belt 5 to the sole 2, for example by fixing or constraining a part or edge of the attachment base 5*b* to the sole 2, or making a sole 2 with at least one tightening strip or tape or belt 5 attached thereto, and
- constraining the second unit comprising the tightening strip or tape or belt 5 and the sole 2 below the second group comprising the upper 3 and the insole 4, preferably taking care to fix, glue or sew another part of the attachment base 5*b* to the upper 3 or, if provided, to the completion part 3*c*.

The step of constraining the tightening strip or tape or belt 5 to the sole 2 may be obtained in different ways, for example by injection or moulding with composite materials separate from each other and subsequently glued or by bi injection, therefore simultaneously, of different specific materials, for example rigid, semi-rigid and elastic.

What has been said with reference to the shoe 1 and more particularly with regard to the steps of constraining the components thereof clearly applies to a method according to the present invention.

With a shoe according to the present invention, once a user has placed a foot in the housing area. RZ after passing through the opening OP, it is possible to pull the tightening strip or tape or belt 5 so as to enclose the housing area RZ and then removably engage it with the engagement means 6 or pull the strip or tape or belt 5 after such engagement.

In any case, thanks to the facilitating or increasing means 7, 3*c* the movement of the strip or tape or belt 5 with respect to the insole 4 and/or the upper 3, an adaptation of the tightening action of the strip or tape or belt 5 on the upper 3 is obtained and more particularly it is possible to obtain an increase of such action, so as to eliminate or mitigate any flexions of the foot or neck of the foot due to problems, such as the pronation of the foot or flat foot.

Figure 3:
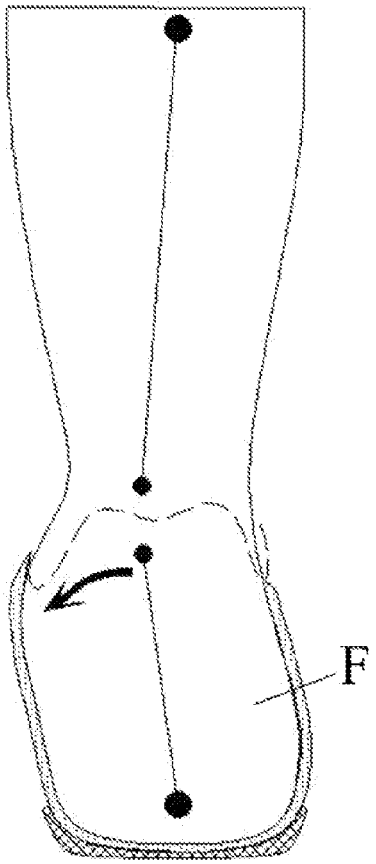
FIG. 3 shows the effect on the foot of a user suffering from pronation housed within a shoe according to the prior art.
Figure 4:
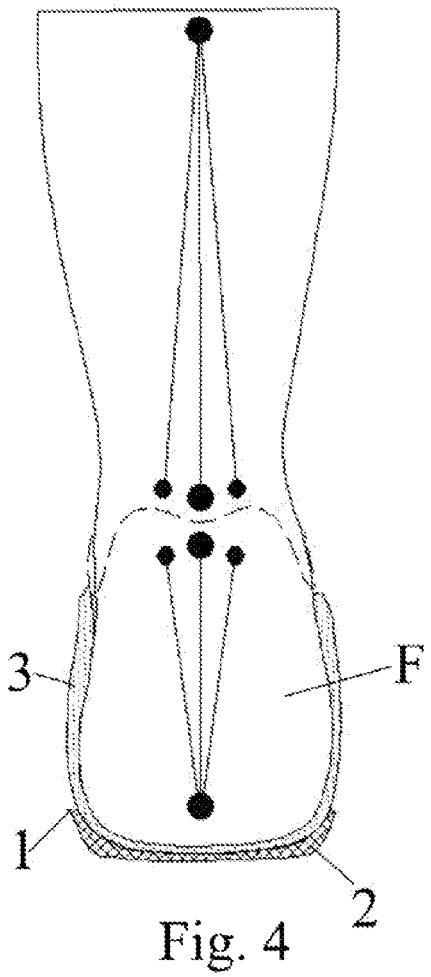
FIG. 4 shows the effect on the foot of a user suffering from pronation housed within a shoe according to the present invention.

With reference to this aspect, reference is made, for example, to FIGS. 3 and 4, which show in the first the flexion or twisting effect on the foot F or the neck of the foot F of a user suffering from pronation housed within a shoe according to the state of the prior art and shows in the second the foot F or the neck of the foot F of a user within a shoe 1 according to the present invention which is not flexed.

In this regard, if the facilitating or increasing means comprise a flexible or deformable section 7 then pulling the strip or tape or belt 5 the flexion of the flexible or deformable section 7, in particular at the notches 9 or the lightening portions, would allow pulling the strip or tape or belt 5 more than if such a section were not present and therefore this increases the tightening action of the strip or tape or belt 5 on the upper 3.

The same applies to the case in which the facilitating or increasing means comprise the elastically extensible or shapable completion part 3*c* of the upper 3, since in this case the strip or tape or belt 5 fixed at said part 3*c*, thus pulling or acting on the strip or tape or belt 5 or better on the end section or free end 5*a* thereof, would release the movement of the strip or tape or belt 5 from the main part 3*b* of the upper 3 ensuring an increase in the tightening action on the latter.

Of course, a solution with a flexible or deformable section 7 and elastically extensible or formable completion part 3*c* would ensure excellent tightening performance.

As will be appreciated, the present invention therefore differs from the teachings of the prior art, by the presence of a mounting insole configured to offer optimal arch support of the foot, for example with jagged, deformable portions, adapted to favour the wrapping effect of the tape or belt around the foot.

An insole designed to support the arch is thus obtained, which is connected to a support system integrated with the upper and sole, which can be easily and precisely adjusted without particular forces by any type of closure, tie, Velcro strap, cable adjusted via a mechanism (e.g. rotor, rack, lever, etc.) in accordance with and in order to support the arch inside a shoe.

Alternatively or additionally, an extensible material portion may be provided along the upper at the area of the arch which facilitates mobility and thus the tightening action of the tape or belt.

A shoe according to the present invention thus allows to obtain a total or better unload of the tension that is generated on the sole on each component of the shoe, while with the current solutions in the best of conditions only the sole is unloaded and not also the rest of the shoe, in particular the upper, so that the solutions according to the state of the art are much less performing and are less effective.

Modifications and variants of the invention are within the scope of protection defined by the claims.

The invention claimed is:

1. A shoe comprising:

a sole, an upper constrained to said sole and an insole inserted in said upper or constrained on an open bottom of the upper, wherein said upper comprises a main part and a completion part, wherein said completion part of the upper is arranged at an inner side of the upper and has greater elasticity than the main part, said shoe also comprising at least one strip or tape or belt or pull component affixed to the completion part of the upper, for tightening said upper around a foot of a user and an adjustable and removable fastener of said at least one strip or tape or belt or pull component on said upper, wherein the insole comprises at least one flexible or deformable section formed in an edge portion only on a medial side of said insole at an attachment base of said at least one strip or tape or belt or pull component to facilitate tightening of said at least one strip or tape or belt or pull component on said upper, wherein the at least one flexible or deformable section of the insole is delimited by two or more notches extending from the edge portion of the insole towards a center line of the insole, to define flexible and separate or foldable fins or members which are bendable at least upwards with respect to the remaining parts of said insole when said at least one strip or tape or belt or pull component is tightened on the upper; and wherein the insole is constrained on a bottom of the upper and is constrained to the sole, or is placed above the sole, which, in turn, is connected to the upper.

2. The shoe according to claim 1, wherein said two or more notches comprise one, two, three or more tabs or portions that are flexible and separate or foldable, and bendable with respect to remaining parts of said insole when said at least one strip or tape or belt or pull component is tightened on the upper.

3. The shoe according to claim 1, wherein said at least one flexible or deformable section is arranged in an edge portion of the insole, during use in whole or in part enclosed by said at least one strip or tape or belt or pull component, such that by tightening the latter a bending is caused of said at least one flexible or deformable section and thus the tightening action of said at least one strip or tape or belt or pull component is increased or facilitated.

4. The shoe according to claim 1, wherein said at least one flexible or deformable section is not firmly constrained or fixed in position, either to the upper, or to the sole, while said insole is firmly constrained or fixed in position, including glued or adhered, to the upper along the entire perimeter edge thereof, except at the flexible or deformable section, such that said at least one flexible or deformable section is free or can be moved with respect to the upper following the tightening action imparted by said at least one strip or tape or belt or pull component.

5. The shoe according to claim 1, wherein said main part and said completion part are elastically extensible, wherein said main part is elastically extensible to a lesser extent than said completion part, wherein said at least one flexible or deformable section comprises said elastically extensible completion part of said upper and wherein said at least one strip or tape or belt or pull component is fixed at said elastically extensible completion part or slidable thereon, to allow said at least one strip or tape or belt or pull component to be moved independently from said main part of said upper.

6. The shoe according to claim 5, wherein said at least one strip or tape or belt or pull component is fixed on a side of said upper.

7. The shoe according to claim 6, wherein said upper delimits a recessed portion and wherein an attachment base of said at least one strip or tape or belt or pull component is housed and fixed in said recessed portion.

8. The shoe according to claim 7, wherein said recessed portion comprises said elastically extensible completion part.

9. The shoe according to claim 6, wherein said at least one strip or tape or belt or pull component is fixed both to said sole and on a side of said upper.

10. The shoe according to claim 1, wherein said sole is hollow or in any case delimits a hollow area or concavity towards said insole, so as to allow said at least one strip or tape or belt or pull component and said insole to travel in a manner such to wind around and sustain the arch of the foot.

11. Method for assembling a shoe according to claim 1, comprising the following steps in sequence:

arranging a sole, an upper, an insole and at least one tightening strip or tape or belt, constraining said at least one tightening strip or tape or belt to said upper, constraining said insole to the unit comprising said at least one tightening strip or tape or belt and said upper or inserting it in said upper, and constraining said sole below the group comprising said at least one tightening strip or tape or belt, said upper and said insole.

12. A method for assembling a shoe according to claim 1, comprising the following steps:

arranging an upper and an insole, constraining said insole below said upper or inserted said insole in said upper, arranging a sole and at least one tightening strip or tape or belt and then constraining said at least one tightening strip or tape or belt to said sole or making a sole with at least one tightening strip or tape or belt constrained thereto, constraining the unit comprising said at least one tightening strip or tape or belt and said sole below the group comprising said upper and said insole.

13. A shoe comprising:

a sole, an upper constrained to said sole and an insole inserted in said upper or constrained on an open bottom of the upper, wherein said upper comprises a main part and a completion part, wherein said completion part of the upper is arranged at an inner side of the upper and has greater elasticity than the main part, said shoe also comprising at least one strip or tape or belt or pull component affixed to the completion part of the upper, for tightening said upper around a foot of a user and an adjustable and removable fastener of said at least one strip or tape or belt on said upper, wherein the insole comprises at least one flexible or deformable section formed in an edge portion only on a medial side of said insole at an attachment base of said at least one strip or tape or belt with respect to said insole and with respect to said upper to facilitate tightening of said at least one strip or tape or belt on said upper, wherein said main part and said completion part are elastically extensible or shaped, while said main part is elastically extensible or shaped to a lesser extent than said completion part, wherein said at least one flexible or deformable section comprises said elastically extensible or shapable completion part of said upper, and wherein said at least one strip or tape or belt or pull component is slidably affixed to said completion part, so as to allow said at least one strip or tape or belt or pull component to be moved independently from said main part of said upper for tightening of the upper, wherein the main part has lower elasticity than the completion part, wherein the completion part is made of light fabric, and the main part is made of at least one of a fabric, leather, synthetic or a composite material with internal reinforcement inserts, and wherein the strip or tape or belt or pull component is attached to the upper or to both the sole and on one side of the upper.

* * * * *